United States Patent [19]

Chu

[11] 4,029,916

[45] June 14, 1977

[54] MULTI-CONTACT PUSH-BUTTON SWITCH AND PLURAL EMBODIMENT FOR KEYBOARD SWITCH ASSEMBLY

[75] Inventor: Pak-Jong Chu, Ottawa, Canada

[73] Assignee: Northern Electric Company Limited, Montreal, Canada

[22] Filed: Apr. 18, 1975

[21] Appl. No.: 569,381

[52] U.S. Cl. ..... 200/5 A; 200/67 DB; 200/159 B; 200/275; 200/340

[51] Int. Cl.[2] ..... H01H 13/70; H01H 1/14

[58] Field of Search ..... 200/1 R, 5 R, 5 A, 67 D, 200/67 DA, 67 DB, 159 R, 159 A, 159 B, 160, 242, 275, 340

[56] References Cited

UNITED STATES PATENTS

| | | | |
|---|---|---|---|
| 3,133,170 | 5/1964 | Nanninga | 200/67 DB |
| 3,472,974 | 10/1974 | McGough | 200/5 R |
| 3,600,528 | 8/1971 | Leposavic | 200/159 B X |
| 3,699,294 | 10/1972 | Sudduth | 200/159 B X |
| 3,742,157 | 6/1973 | Leposavic | 200/159 B X |
| 3,761,944 | 9/1973 | Shimojo | 200/159 B X |
| 3,796,843 | 3/1974 | Durkee et al. | 200/159 B X |
| 3,800,104 | 3/1974 | Lien et al. | 200/159 A X |
| 3,823,309 | 7/1974 | Caruso | 200/5 A X |
| 3,826,882 | 7/1974 | Giolitti et al. | 200/67 DA |
| 3,856,998 | 12/1974 | Sims, Jr. | 200/5 A |
| 3,870,840 | 3/1975 | Rivetta et al. | 200/159 A X |
| 3,916,135 | 10/1973 | Holden et al. | 200/67 R X |
| 3,941,953 | 3/1976 | Misson et al. | 200/5 R |
| 3,941,964 | 3/1976 | Yoder | 200/159 A |
| 3,996,429 | 12/1976 | Chu et al. | 200/5 A |

FOREIGN PATENTS OR APPLICATIONS

| | | | |
|---|---|---|---|
| 2,459,464 | 6/1975 | Germany | 200/340 |

*Primary Examiner*—James R. Scott
*Attorney, Agent, or Firm*—Sidney T. Jelly

[57] ABSTRACT

A push button switch has a spring contact plate and a circuit board in superposed position. The spring contact plate has one or more switch positions, each switch position comprising a prestressed domed portion surrounded by a flat sheet portion. The domed portion includes a central portion and radial webs connecting the central portion to the flat sheet portion. Spring contacts extend radially from the central portion, each contact between a pair of webs. The domed portion is prestressed to assume a stable position offset upwards from a plane coincident with the flat sheet portion, and the webs each have an upwardly bent portion at the junction with the flat sheet portion. A push button acts on the central portion and pressure on the push button causes the central portion to snap through the plane of the flat sheet portion, with the spring contacts contacting contact areas on the circuit board. Release of the push button enables the domed portion to snap back to the stable position.

6 Claims, 13 Drawing Figures

MULTI-CONTACT PUSH-BUTTON SWITCH AND PLURAL EMBODIMENT FOR KEYBOARD SWITCH ASSEMBLY

This invention relates to multi-contact push-button switches, and particularly to such switches having a snap-action.

Switches in accordance with the present invention are particularly suitable for telephone sets and other forms of electrical and electronic apparatus.

It is a constant requirement that switches be made more compact, requiring a minimal space in the apparatus. At the same time the switch should be simple and reliable. In a telephone, and other apparatus, the push-button is actuated by users who may actuate the push-button with widely varying characteristics, which characteristics could influence the signal quality resulting from the switch actuation. The particular characteristics of the push-button, such as feedback, operating force and button travel are therefore important.

The present invention provides a push-button switch which has a snap-action which action positively ensures proper switch contact, and also gives a positive "feel" to the switch actuation. The push-button switch has a pre-strained dome-shape spring contact plate. This contact plate undergoes the snap-action after a predetermined amount of applied force by the push-button, and snaps back after removal of the force.

In a particular form of the invention the switch has a plurality of contacts spaced around a central point. The particular details, advantages and actuation relating to these particular features, and to other features will be readily understood by the following description of certain embodiments, by way of example, in conjunction with the accompanying drawings, in which.

Figure 1:
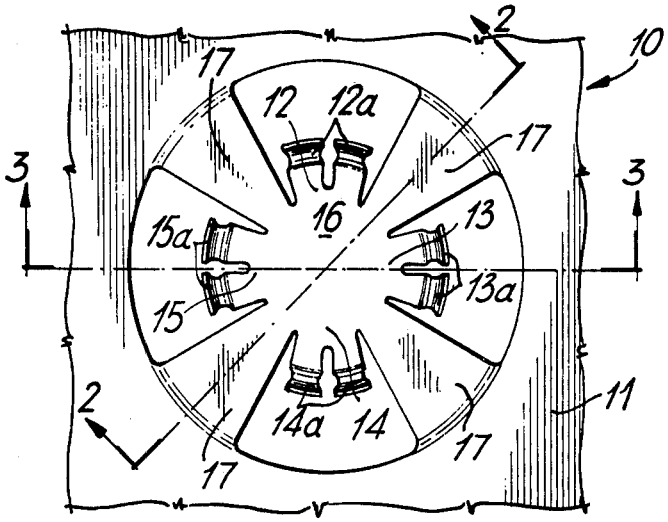
FIG. 1 is a plan view of one form of spring contact plate.
Figure 2:
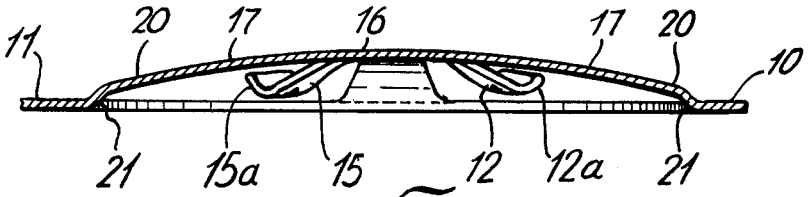
FIG. 2 is a cross-section on the line 2—2 of FIG. 1.
Figure 3:
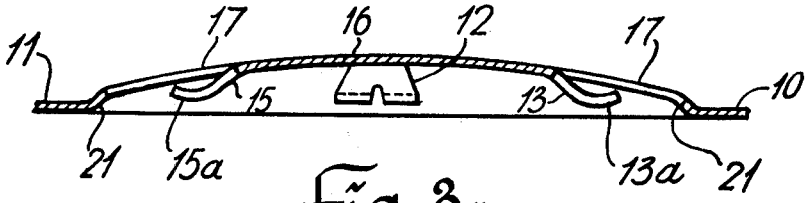
FIG. 3 is a cross-section on the line 3—3 of FIG. 1.

As illustrated in FIGS. 1, 2 and 3, a spring contact plate 10 is in the form of a stamping, for example of stainless steel. There is a flat sheet portion 11 surrounding a contact portion which comprises four contacts 12, 13, 14 and 15. The contacts extend radially from a central portion 16 connected to the flat sheet portion 11 by radial connecting webs 17. The contacts 12, 13, 14 and 15, and central portion 16 and webs 17 are formed from the sheet portion 11 and are given a pre-stressed domed formation, as seen in FIGS. 2 and 3. The outer ends of the contacts 12 to 15 are formed to give downwardly extending rib formations — 12*a* – 15*a* respectively, these rib portions forming the actual contact areas.

When pressure is applied to the central portion, in a downward direction as seen in FIGS. 2 and 3, the centre portion moves down with flexing of the webs 17. At a particular position the centre portion snaps down, still however having a residual stress tendency to return the centre portion 17 to the normal position as in FIG. 2. The webs 17 each flex or buckle at a position 20 just radially inward from the junction portion 21 with the flat-sheet portion 11. It will be seen that these junction portions have an initial upward bend and the webs bend down again just inside the portions 21, as seen in FIG. 4.

Figure 4:
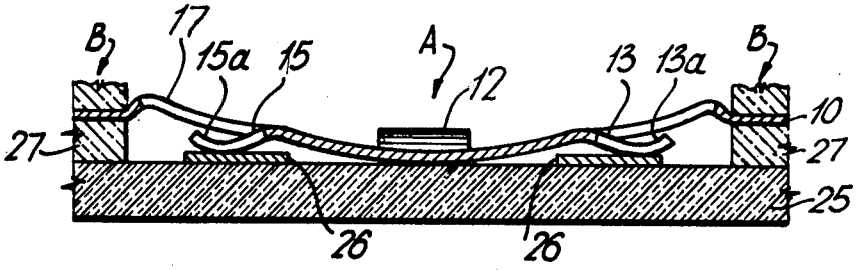
FIG. 4 is a cross-section of the spring contact plate of FIG. 1, as on the line 3—3, but illustrating the contact plate in an actuated condition.

In FIG. 4, a contact board is indicated diagrammatically at 25 and a spacer is indicated at 27. The snap-action and return force of the contact plate can vary depending upon the particular design. Thus a domed plate can be arranged to have a bistable condition, being stable in a non deflected condition, as in FIGS. 2 and 3 for example, and also being stable in a fully deflected condition. Such a plate would not have any return force present to restore the plate to a non-deflected condition. In such an arrangement, the contact board 25 is positioned relative to the contact plate 10, by spacer 27, such that the central portion 16 is enabled to deflect down sufficiently to reach its alternative stable state. In such an arrangement the central portion 16 will always snap back on release of the operating force — exemplified by the arrow A in FIG. 4. As the contacts 12*a* to 15*a* make contact with the related contact areas on the contact board 25 there is a radial wiping action by the contacts on the contact areas. This is an important feature in that good electrical contact is obtained.

It is also possible to design the contact plate such that the central portion has only one stable condition, the undeflected condition as in FIGS. 2 and 3. The contact plate 10 illustrated in FIGS. 1 to 4 is conveniently of this type, the single stable state being created by the particular formation of the upwardly bent junction portion 21. This provides a positive return force on the central portion at all times, although the central portion will snap down under pressure at the centre. Other formations for ensuring a positive return force at all times can be provided.

A further effect on the snap-action and return force is provided by the clamping of the flat portion 11 surrounding the domed portion. Clamping pressures, indicated by arrows B in FIG. 4 affect the return force and can alter a bistable contact plate to a more stable form, when clamped.

Figure 5:
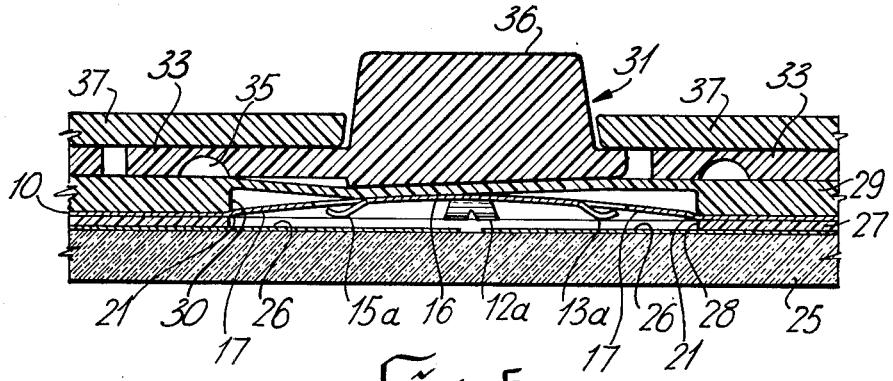
FIG. 5 is a cross-section through one form of push-button switch incorporating a contact plate as in FIGS. 1 to 4.
Figure 10:
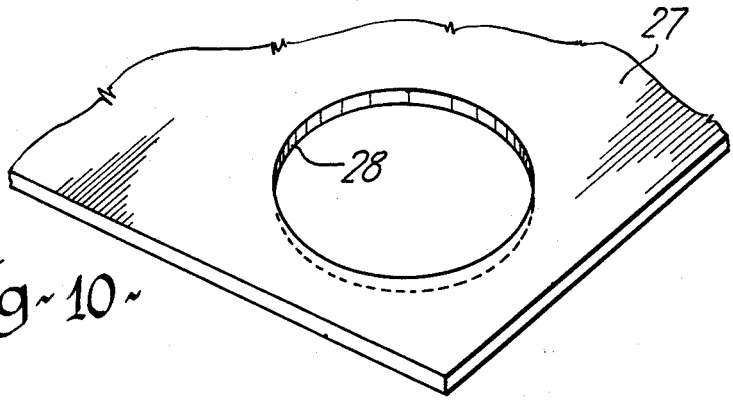
FIG. 10 is a perspective view of a spacer as used in the switch of FIG. 5.
Figure 11:
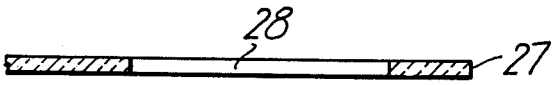
FIG. 11 is a plan view of the spacer of FIG. 9.

FIG. 5 illustrates one form of push-button switch incorporating a spring contact plate as in FIGS. 1 to 4. The switch comprises a rigid base member 25, in the present example a printed circuit board having a printed circuit 26 thereon. An insulating spacer 27 is positioned on the base member 25. As seen in FIGS. 10 and 11, the spacer 27 is of flat material having a circular hole 28 therein. The hole 28 is aligned with the contact plate 10.

Figure 8:
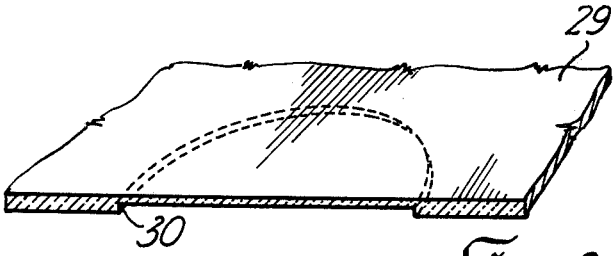
FIG. 8 is a perspective cross-sectional view of a resilient diaphragm as used in the switch of FIG. 5.
Figure 9:
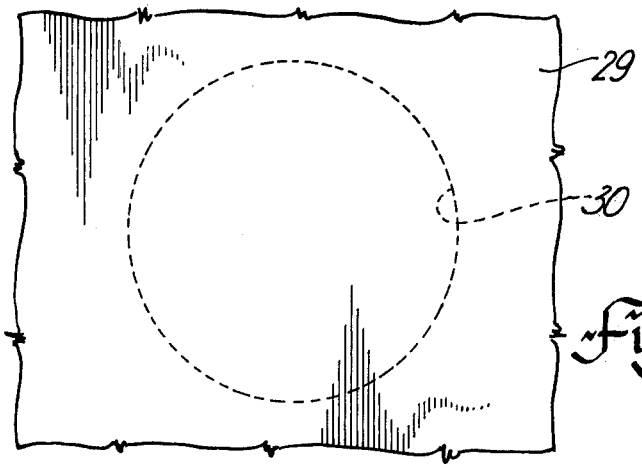
FIG. 9 is a plan view of the diaphragm of FIG. 7.

The contact plate 10 rests on the spacer 27 and positioned over the contact plate 10 is an elastic diaphragm 29. This diaphragm is illustrated in FIGS. 8 and 9 and comprises a flat sheet of elastic material having a circular recess 30 in its under surface. The recess is positioned over the formed portion of the contact plate 10.

Figure 6:
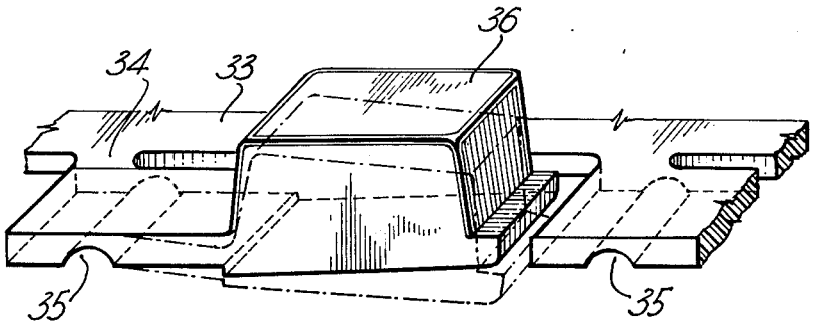
FIG. 6 is a perspective cross-sectional view of a pivotal push-button as used in the switch of FIG. 5.
Figure 7:
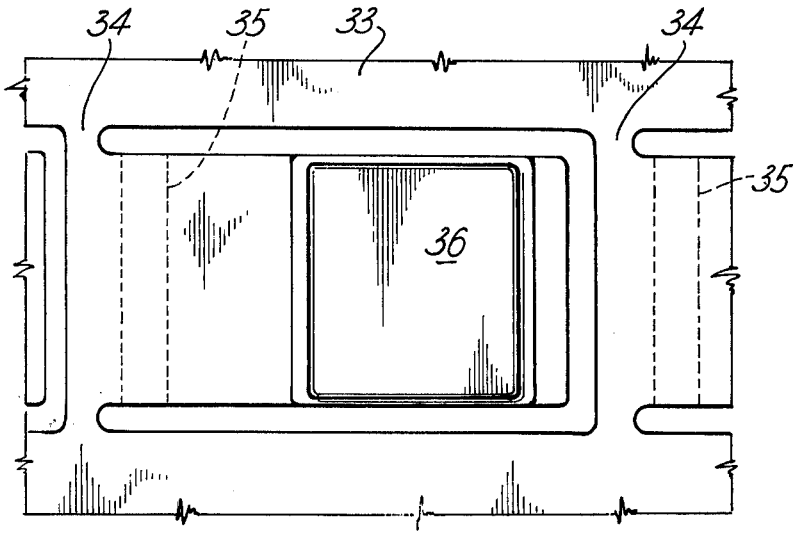
FIG. 7 is a plan view of the push-button of FIG. 11.

A push button 31 is positioned on top of the diaphragm 29. In the present example the push button is pivotally or hingedly mounted and is seen in more detail in FIGS. 6 and 7. The push button is formed as part of a flat member 33, the button separated for most of its periphery from the member 33, connected at one portion 34. The button comprises a flat portion having a reduced thickness portion 35 which acts as a hinge. There is also a thickened portion 36 which forms the button which extends through a cover or key frame 37.

Generally, push button switches are provided a plurality at a time, for example a push button dial for a telephone, a keyboard on a computer input terminal and other forms of apparatus. In such examples, the contact plate comprises a flat sheet with a plurality of contact positions formed therein, one for each switch. Similar the spacer 27 and diaphragm 29 each comprise a flat sheet with a corresponding plurality of holes 28 and recesses 30 respectively. The push button can also be formed in a common flat member 33, as can be seen from FIGS. 6 and 7.

On assembly the push button is in contact with the recessed portion of the diaphragm 29, which in turn is in contact with the centre portion 16 and webs 17 of the contact plate. Pressure on button 36 causes the push button to hinge at 35, pushing down the diaphragm and also the central portion 16. After a short movement of the central portion 16 there is a snap-action with the contact web formations 12*a* to 15*a* moving rapidly and positively into contact with the printed circuit 26, the push button following up under the pressure of the user's finger. There is thus a distinct "feedback" to the user who feels the snap-action and sudden movement. On release of the pressure on the button the central portion snaps back to its original position as a result of stresses at the flexing positions 20 and junction portions 21.

Figure 12:
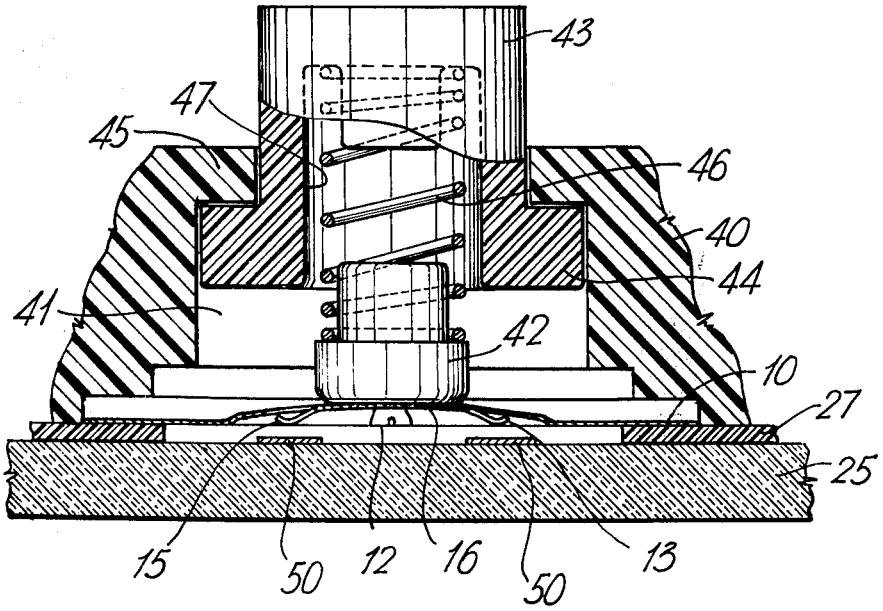
FIG. 12 is a cross-section through an alternative form of push-button switch incorporating a contact plate as in FIGS. 1 to 4.

The push button of the example illustrated in FIG. 5 has a short operating movement. FIG. 12 illustrates a switch having a longer movement. The base member 25, printed circuit 26, spacer 27 and spring contact plate 10 are as in FIG. 5.

In the example of FIG. 12, a cover plate or member 40 fits over the contact plate 10 and spacer 27, and has a cylindrical bore 41. Positioned in the bore 41, and resting on the centre portion 16 of the contact plate 20 is a lower button member 42. Also positioned in the bore 41 is an upper button member 43. Button member 43 has an outwardly extending flange 44 and an inwardly extending flange 45 on cover plate 40 retains the upper button member in the bore 41. A light compression spring 46 extends between the lower and upper button members 43 and 42, the spring resting against abutments on these members. The lower button member is aligned with an axially extending recess 47 in the upper button member 43. Pressure on the upper button member 43 compresses spring 46, the upper button member 43 sliding down over the lower button member 42. The spring 46 in turn pushes down the lower button member 42 and this pushes down the centre portion 16 of the contact plate 10. Again, after a small deflection of the centre portion 16 there is a snap-action, the lower button member following the downward movement of the contact plate under the pressure of the spring 46. On release of the upper button member 43, the spring pressure on the lower button member is removed and the spring contact plate returns to its normal condition, as in FIG. 12, pushing up the lower button member 42.

Figure 13:
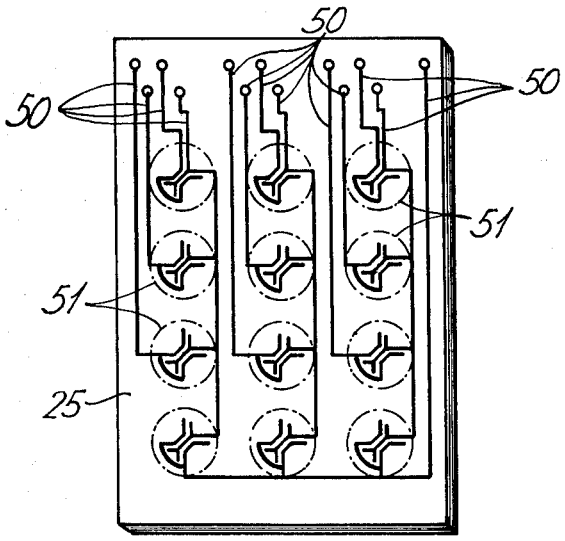
FIG. 13 is a perspective plan view of a printed circuit board on which is to be mounted a plurality of push-button switches.

When used in a telephone set, or many other forms of apparatus, several push button switches are mounted on a common base member 25 as described above. FIG. 13 illustrates one form of base member 25 having a plurality of printed circuits or conductors 50 thereon. The positions of individual switches are indicated by the dotted circles 51. In the example illustrated each switch is connecting four pairs of contacts, or making two signals simultaneously, with four making chances. The number of contacts made, and signals made, can be varied, by variation in the contact pattern and by variation in the form and number of the contacts 12 to 15. The conductors 50 are also indicated in FIG. 12.

Thus the number of contacts per button can be varied, but the number of contacts which can be accommodated under each button is limited. For telephone and similar uses, four contacts are usually sufficient.

What is claimed is:

1. A pushbutton switch including a flat spring plate having a switch position comprising:

a pre-stressed domed portion extending upwardly from said flat spring plate and having a central portion and a plurality of radial webs connecting said central portion and said flat spring plate, said flat spring plate surrounding said domed portion, said flat spring plate integral with the outer ends of said radial webs to constrain said webs radially and circumferentially;

an upwardly bent portion at the junction between each web and said flat spring plate, said bent portion constraining said webs to deflect radially inward of said bent portion;

a plurality of cantilevered spring contact members extending from said centre portion, a contact member between at least one adjacent pair of radial webs and extending a radial distance less than said radial webs, said contact member extending downward from said domed portion toward the plane of said flat spring plate;

a contact area at the radially outward end of each contact member;

a circuit member positioned below and spaced from said flat spring plate and including contact areas beneath said contact areas of said spring contact members;

a pushbutton mounted above said flat spring plate, over said domed portion to apply a downward force thereto, to deflect said domed portion;

said domed portion, on application of said downward force, arranged to snap downward toward said circuit member, said domed portion constrained by said upwardly bent portion to return said domed portion to an undeflected position.

2. A pushbutton switch as claimed in claim 1, including a flat spring plate having a plurality of switch positions.

3. A push button switch as claimed in claim 2, each push button comprising:

a lower button member acting on said central portion;

an upper button member in substantial axial alignment with said lower button member; and a spring interposed between said upper and lower button members.

4. A push button switch as claimed in claim 2, including a cover member extending over said spring contact plate, and a plurality of apertures in said cover member, an aperture for each said upper button member, and interengaging formations on said upper button member and said cover member retaining said upper button member.

5. A pushbutton switch as claimed in claim 2, including a multiple pushbutton member positioned over said flat spring plate, each pushbutton hingedly attched to said pushbutton member.

6. A pushbutton switch as claimed in claim 5, said pushbutton formed in a common member, each pushbutton attached to said common member by a hinge portion.

* * * * *